US007677433B2

(12) United States Patent
Little

(10) Patent No.: US 7,677,433 B2
(45) Date of Patent: Mar. 16, 2010

(54) MATERIALS FOR AND METHOD FOR MANUFACTURING CONTAINER AND RESULTING CONTAINER

(75) Inventor: Troy Little, Thomasville, PA (US)

(73) Assignee: York Container Company, York, PA (US)

( * ) Notice: Subject to any disclaimer, the term of this patent is extended or adjusted under 35 U.S.C. 154(b) by 14 days.

(21) Appl. No.: 12/134,695

(22) Filed: Jun. 6, 2008

(65) Prior Publication Data

US 2009/0305857 A1 Dec. 10, 2009

(51) Int. Cl.
*B65D 43/00* (2006.01)

(52) U.S. Cl. ..... 229/120.15; 229/120.14; 229/120.24; 229/120.26; 229/120.31; 206/744; 206/750; 248/174; 211/72; 211/85; 211/135; 211/149

(58) Field of Classification Search ..... 206/744, 206/746, 747, 748, 749, 750, 232, 45.28, 206/45.29, 45.3; 229/120.14, 120.15, 120.19, 229/120.21, 120.24, 120.28, 120.37, 120.25, 229/120.31; 312/258, 259, 262, 315, 316; 211/72, 85, 135, 149; 248/174; 108/179
See application file for complete search history.

(56) References Cited

U.S. PATENT DOCUMENTS 2,002,618 A * 5/1935 Sutter ..... 206/45.28
2,134,964 A * 11/1938 Whitehead ..... 206/740
2,148,533 A * 2/1939 Chapman ..... 206/45.29
2,771,986 A * 11/1956 Bekoff ..... 206/45.3
2,884,179 A * 4/1959 Rossum ..... 229/120.14
2,903,176 A * 9/1959 Crane ..... 206/510
2,922,552 A * 1/1960 Berger et al. ..... 222/185.1
3,017,064 A * 1/1962 Davis ..... 206/510
3,034,698 A 5/1962 Forrer
3,155,234 A * 11/1964 David et al. ..... 206/232
3,397,831 A 8/1968 Adams
3,765,044 A * 10/1973 Hanahan et al. ..... 15/104.8
4,056,223 A 11/1977 Williams
4,068,796 A 1/1978 Kullman, Jr.
4,874,125 A 10/1989 Bates
4,927,073 A * 5/1990 Esposito ..... 229/117.07
4,961,500 A * 10/1990 Coulombe ..... 206/366
5,213,220 A * 5/1993 McBride ..... 211/132.1
5,315,936 A * 5/1994 Smith ..... 108/165
5,375,715 A 12/1994 Serre et al.
5,400,955 A 3/1995 Coalier et al.
5,505,368 A 4/1996 Kanter et al.
6,068,140 A * 5/2000 Mangrum et al. ..... 211/132.1
6,158,653 A 12/2000 Kanter et al.
6,325,282 B1 12/2001 Kanter et al.

(Continued)

*Primary Examiner*—David T Fidei
(74) *Attorney, Agent, or Firm*—Barnes & Thornburg LLP

(57) ABSTRACT

In accordance with the invention, a method of manufacturing containers such as shipping, display and display ready packaging, for example, and resulting containers and associated preassemblies and blanks are provided, which, when utilized, result in preassemblies that are more easily and quickly assembled into fully assembled containers. According to the invention, a primary flank is affixed to an auxiliary blank using adhesive applied to a second portion section of each of the plurality of divider sections included in the primary blank, such that, as the container is assembled, pressure on the auxiliary blank separates a first portion of each of the plurality of divider sections from second portion and carries each of the plurality of divider tabs to engage with corresponding lock slots of the first and/or second divider lock.

27 Claims, 9 Drawing Sheets

U.S. PATENT DOCUMENTS

| | | | | |
|---|---|---|---|---|
| 6,817,514 | B2 | 11/2004 | Kanter et al. | |
| 6,874,679 | B2 | 4/2005 | Tibbles et al. | |
| 2005/0189258 | A1 * | 9/2005 | Vastola | 206/570 |
| 2006/0060643 | A1 | 3/2006 | Sheffer | |
| 2007/0187346 | A1 * | 8/2007 | Markson et al. | 211/85.26 |
| 2008/0169339 | A1 * | 7/2008 | Moser | 229/108.1 |
| 2008/0169340 | A1 | 7/2008 | Sheffer | |
| 2008/0265726 | A1 * | 10/2008 | Sheffer | 312/259 |

* cited by examiner

MATERIALS FOR AND METHOD FOR MANUFACTURING CONTAINER AND RESULTING CONTAINER

The invention relates in general to the manufacture of containers that may be readily used to ship and or display contents following delivery of the container, as specified in the independent claims.

BACKGROUND OF THE INVENTION

Various containers are conventionally provided as packaging for shipping or for display of product in a retail environment to prospective customers. As is conventionally known in the industry, such containers can be transported to manufacturing and/or retail environments for use in shipping or display in knock-down form; i.e., flattened but otherwise being glued, stapled or otherwise secured together, such that they are already substantially pre-assembled; such knock-down form containers are also referred to as preassemblies. In such a "knockdown" state (i.e., knocked down or not set-up), personnel assembling the product container need only open the sides and or ends of the container and affix the package bottom wall into its assembled condition. As a result, such containers assembly may be performed such that the product can be placed into a resulting assembled container for shipping or as display package for ready display.

However, the time required for assembling such containers can be somewhat lengthy as assembly of a container may require a number of separate actions to be performed by the assembler. The number of such separate actions is conventionally referred to as the number of "touches" required for assembly; thus, a container requiring complex assembly requires a greater number of touches than a container requiring relatively simple assembly.

SUMMARY

The following presents a simplified summary in order to provide a basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to the more detailed description below.

In accordance with illustrated embodiments, a method of manufacturing containers and resulting containers and associated preassemblies and blanks, which, when utilized, result in containers that are set up or finally assembled using a global shelf installation operation to assemble a plurality of shelves to hold product.

Additionally, in accordance with illustrated embodiments, the container may be used in other implementations to provide simple assembly divided containers for shipping and/or display ready packaging including a plurality of compartments, wherein the compartments are formed as part of the set up or final assembly of the container, which includes a global divider installation operation to assemble a plurality of dividers to compartmentalize the assembled container.

These illustrated embodiments are achieved by a combination of features recited in the independent claims. Accordingly, dependent claims prescribe further detailed implementations of the present invention.

BRIEF DESCRIPTION OF THE DRAWINGS

Various embodiments are described herein, by way of example only, with reference to the accompanying drawings. With specific reference now to the drawings, it should be understood that the particulars shown are by way of example and for purposes of discussion of illustrated embodiments only, and are presented in order to provide what is believed to be a useful and readily understood description of the principles and concepts of the invention. In this regard, no attempt is made to show structural details of the invention in more detail than is necessary for a fundamental understanding of the invention, the description taken with the drawings making apparent to those skilled in the art how the several forms of the invention may be embodied in practice.

Accordingly, a more complete understanding of the present invention and the utility thereof may be acquired by referring to the following description in consideration of the accompanying drawings, in which like reference numbers indicate like features, and wherein.

DETAILED DESCRIPTION OF THE INVENTION

In the following description of various invention embodiments, reference is made to the accompanying drawings, which form a part hereof, and in which is shown, by way of illustration, various embodiments in which the invention may be practiced. It is to be understood that other embodiments may be utilized and structural and functional modifications may be made without departing from the scope and spirit of the present invention.

Although knockdown display containers (i.e., a preassembly) provide the opportunity for product manufacturers and retailers to present product in a customized manner, the time required for assembling such containers varies depending on the number of touches required for assembling the container. Therefore, although the use of display containers can improve sales of product in a retail environment and improve the retailer's ability to use retail space efficiently (e.g., when a display container is used, for example, as a powerwing), the fulfilment cost and time to assemble the display detracts from the utility provided by the display container. Thus, there is a need to reduce the number of touches required for final assembly of a container, for example, a shipping package, display or display ready package or compartmentalized package so as to reduce fulfilment cost and time.

With this understanding in mind, a description of various invention embodiments is now provided.

According to as least one illustrated embodiment, there is provided equipment configured to manufacture containers, e.g., for display of product (as well as corresponding container preassemblies and blanks) that result in containers that includes a pad connected to all of a plurality of shelves such that a global shelf/divider installation operation may be used to assemble a plurality of shelves.

Figure 1:
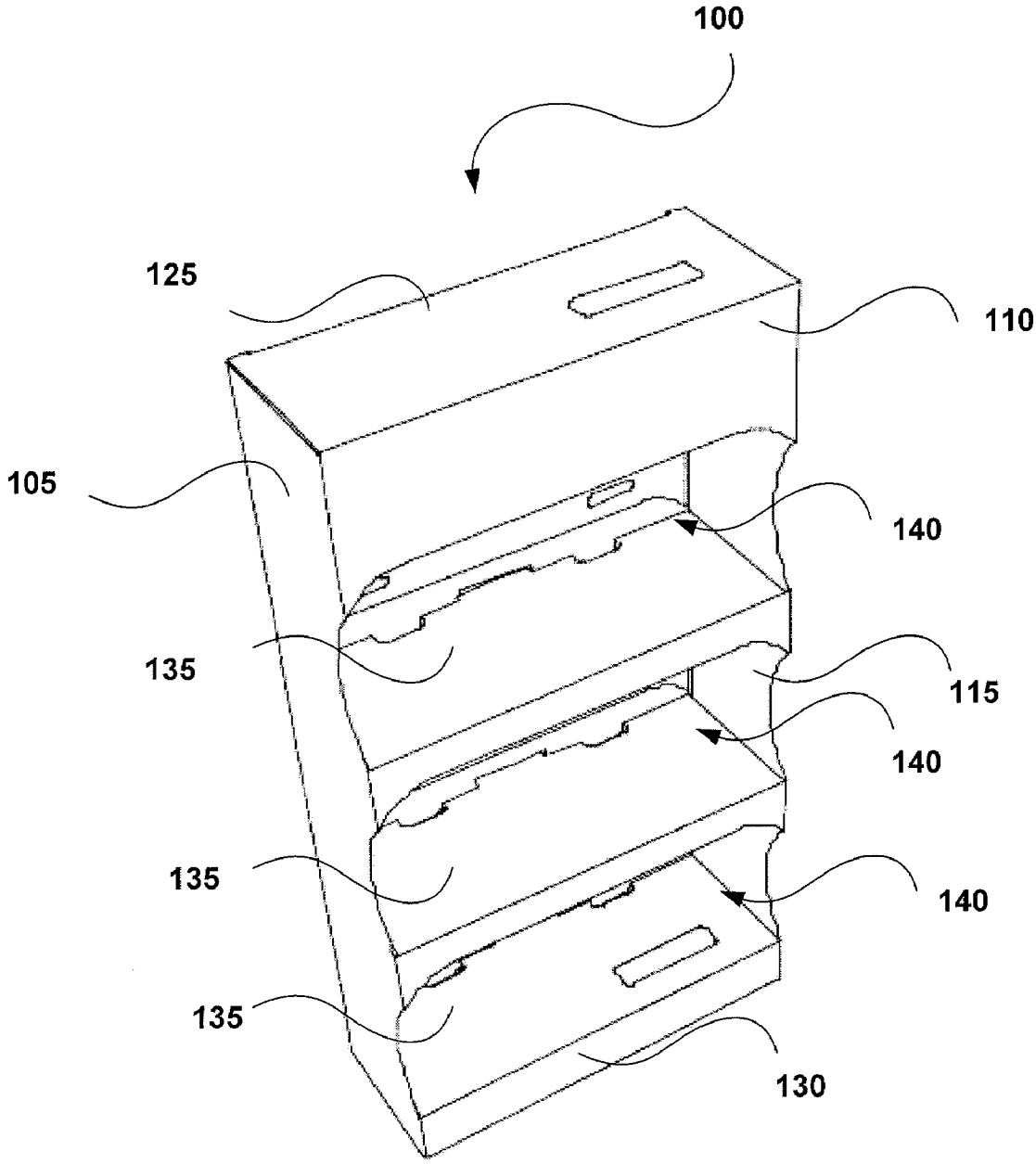
FIG. 1 illustrates a side perspective view of a container manufactured in accordance with an illustrated embodiment.

Understanding of the manufacturing of a container, blanks and/or preassemblies in accordance with invention embodiments may best be understood by first reviewing an illustration of a manufactured container provided in accordance with one illustrated embodiment. As illustrated in FIG. 1, one example of such a container 100 may include a plurality of cells 140 defined as the space between exterior walls 105 (first side), 110 (front side), 115 (second side), 120 (back side-not illustrated in FIG. 1), 125 (top side) and 130 (bottom side), and shelves/dividers 135, which in this illustrated example is a display ready container. Such a container may be used for various display purposes including placement on a display floor, sitting on a pedestal or counter or for use with a powerwing. However, it should be understood that the manufactured container may be any type of container including, for example, any carton, package, box, etc. of any suitable type.

As will be appreciated from the remaining disclosure by one of ordinary skill in the art, the container 100 may be used to display product therein in a retail environment. Thus, subsequent to arrival at a retail environment or off-site fulfilment or contract packaging facility, a knockdown version of the container 100 may be assembled and product placed in the container 100 for display in cells 135

Figure 2:
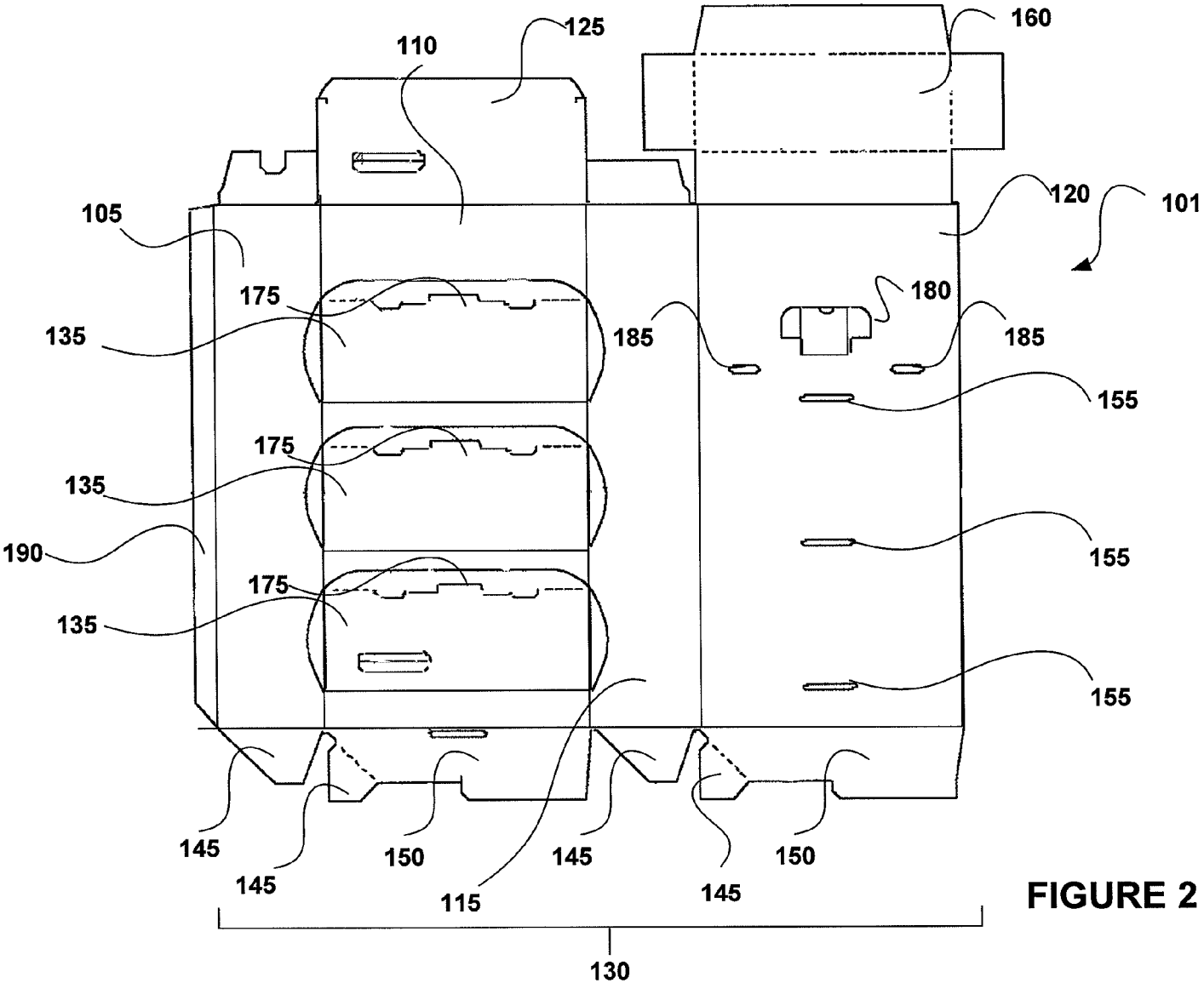
FIG. 2 illustrates an example of a primary blank used in manufacturing the container of the type illustrated in FIG. 1.

FIG. 2 illustrates an example of a primary blank 101 (which may be thought of as a conventional tray) for what is conventionally known as an autolock bottom carton such as the one illustrated in FIG. 1. The knockdown of the container 100 is manufactured by joining the primary blank 101 with an auxiliary blank 102 (which may be thought of as a pad) illustrated in FIG. 3, as explained herein. The blank 101 illustrated in FIG. 2 corresponds to the exterior of the container 100 illustrated in FIGS. 1 and 5-8; therefore, the container 100 includes primary blank 101. Likewise, the container 100 also includes auxiliary blank 102 illustrated separately in FIG. 3 and in conjunction with primary blank 101 in FIG. 4.

As used in FIG. 2, solid lines indicate edges of the blank illustrated, whereas dashed lines indicate perforation, folding or scoring lines provided as part of manufacturing to enable folding of the blanks along the dashed lines.

As shown in FIG. 2, the primary blank 101 includes five major panels: two side panels 105, 115, a front panel 110, a back panel 120 and a top panel 125, corresponding to the side exterior walls, front wall, back wall and top of the container 100. For convenience, the same reference numerals are used to denote the walls of the container 100 and the panels of the primary blank 101. The primary blank 101 also includes a plurality of minor panels 145 and major panels 150 that cooperate as part of assembly to produce the bottom exterior wall 130 (in this example, panels configured to provide a slotted bottom carton).

Also included in blank 101 are divider/shelf lock slots 155 which, when the container 100 is finally assembled, interact with tabs 175 provided on the dividers/shelves 135. In the example of primary blank 101, various apertures 180, 185 are also provided in the back panel 120 to use when the container 100 is used with a pedestal (i.e., t-lock 180) or as a powerwing (powerwing clip slots 185) display. Accordingly, apertures 180, 185 may be omitted in the blank 101 because they are not central to the inventive concept.

Figure 8:
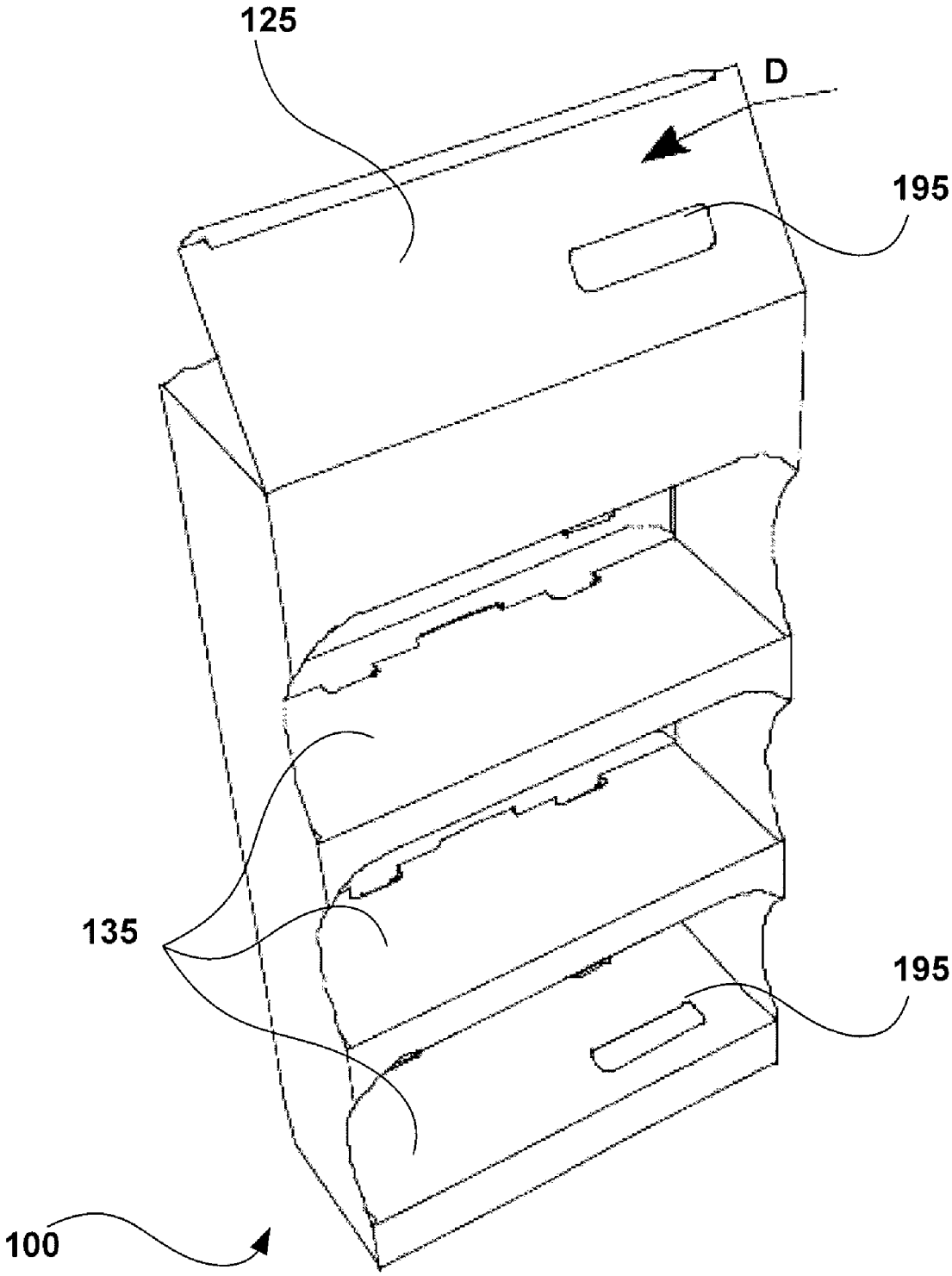
FIG. 8 illustrates a side perspective of the pre-assembly manufactured from the blanks illustrated in FIG. 4 at a fourth stage of final assembly.

Additionally, primary blank 101 includes head space filler panels 160, which, when folded and inserted into the container 100 during final assembly provide a head space filler for use in the finally assembled container 100 (as discussed herein with reference to FIG. 8). However, the head space filler panels 160 may also be omitted in the blank 101 because they are not central to the inventive concept.

Figure 3:
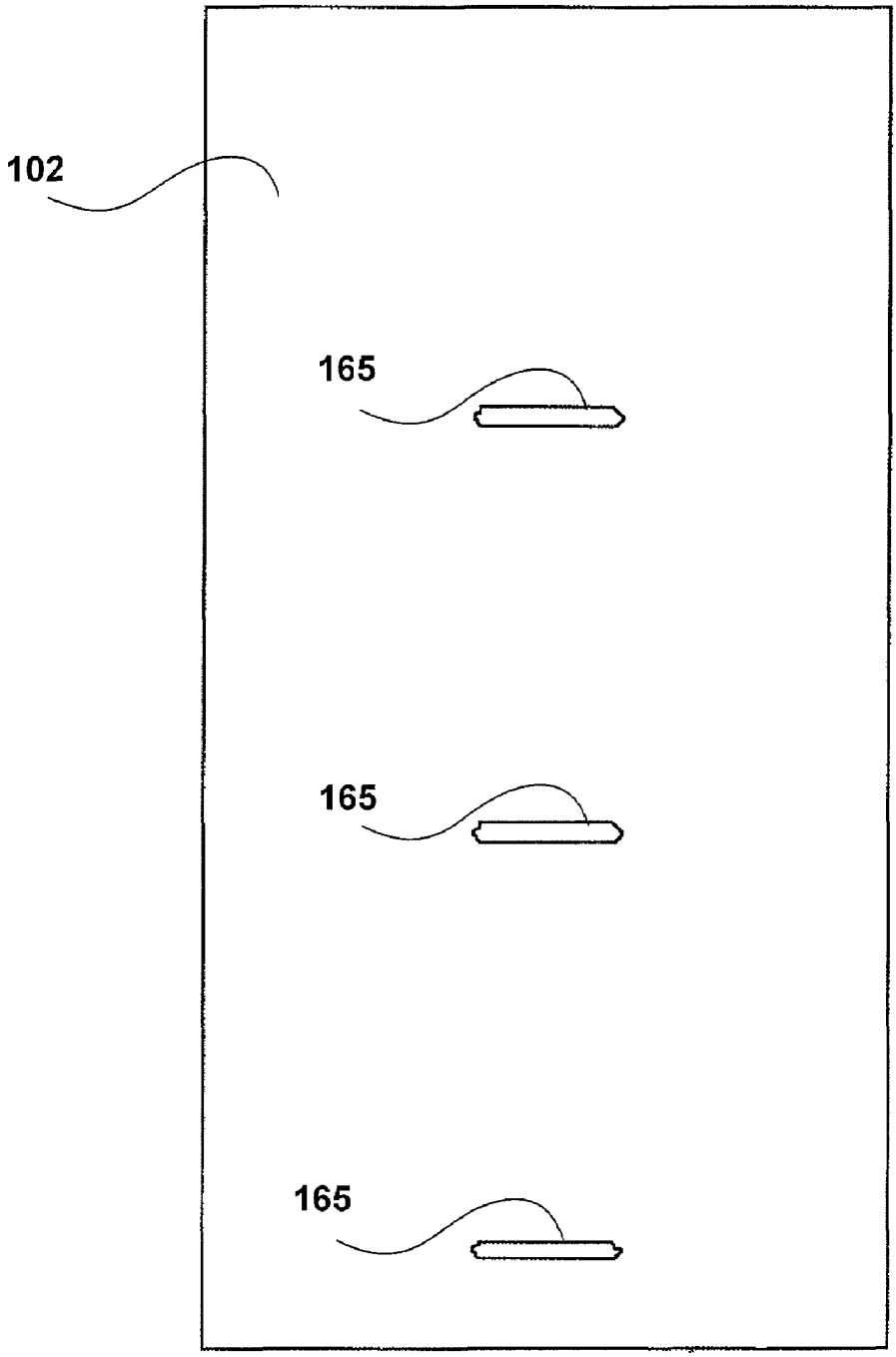
FIG. 3 illustrates an example of an auxiliary blank used in manufacturing the container of the type illustrated in FIG. 1.

FIG. 3 illustrates an example of an auxiliary blank 102 used in manufacturing the container of the type illustrated in FIG. 1. The auxiliary blank 102 includes a plurality of divider/shelf lock slots 165 that interact with tabs 175 provided on the dividers/shelves 135 as part of final assembly of the container 100. It should be appreciated that, although FIG. 3, and other figures illustrate specific configurations for lock slots and tabs, e.g., 155, 165, 175, the inventive concept applies to various different configurations both known and not yet developed in the container manufacturing industry. Accordingly, one of ordinary skill in the art would appreciate that the inventive concept is not limited to the illustrated configuration.

Figure 4:
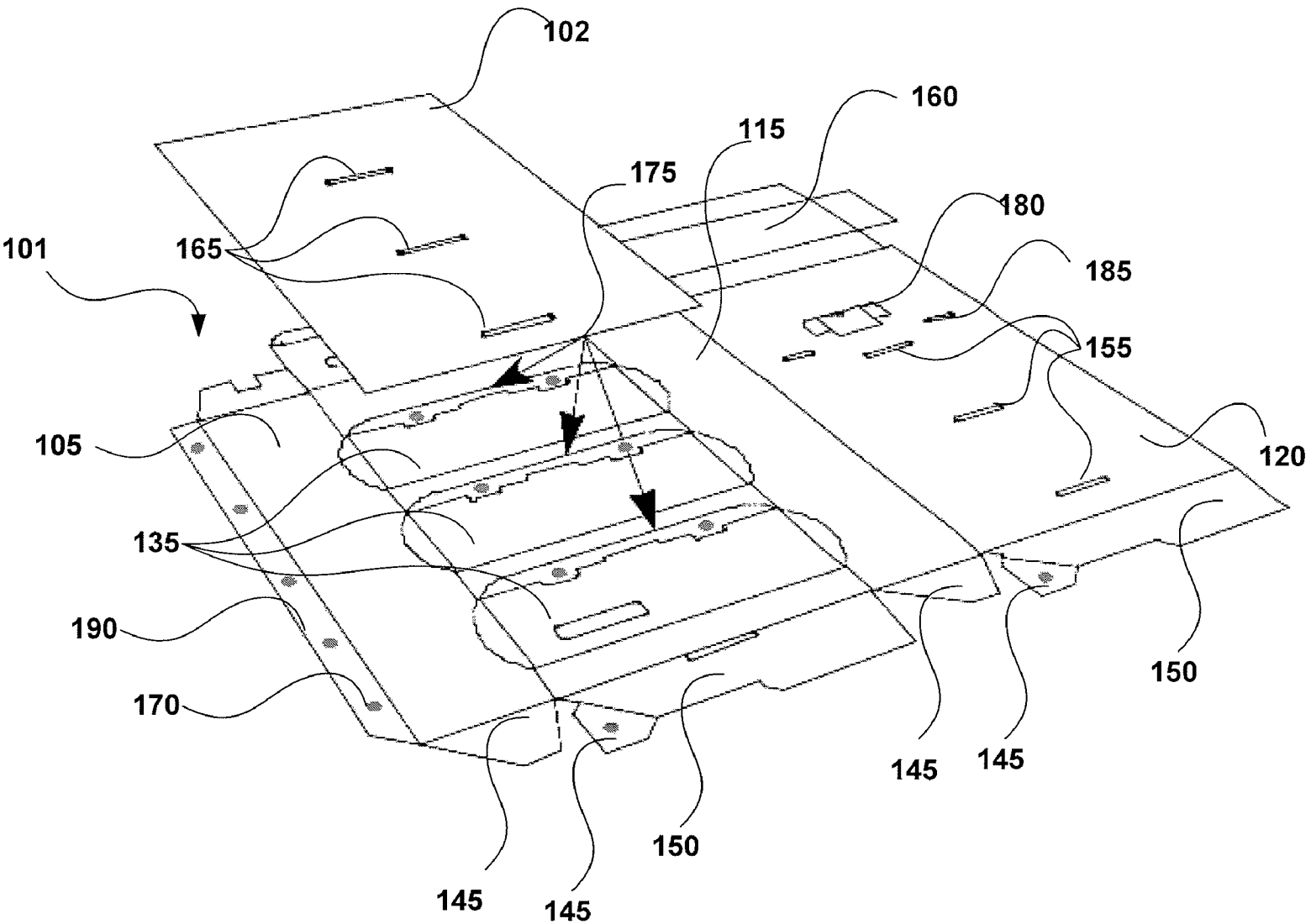
FIG. 4 illustrates the interconnectedness of the primary and auxiliary blanks illustrated in FIGS. 2 and 3 to provide the container illustrated in FIG. 1.

Accordingly, as illustrated in FIG. 4, the primary and auxiliary blanks 101, 102 are affixed to one another in various locations of the blanks so as to provide a knockdown or preassembly for the container illustrated in FIG. 1.

As a first operation in manufacturing the preassembly for the container 100, the faces of the primary and auxiliary blanks 101, 102 are affixed together at various locations. The faces may be affixed in one or more suitable manners including, for example but not limited to, application of adhesive on one or both of the affixed faces, use of staples, tape, etc. For illustrative purposes, FIG. 4 includes various adhesive locations 170 that denote the location of adhesive or some other affixing mechanism. As shown in FIG. 4, such adhesive locations 170 (illustrated as dots) are provided on the front panel 110 just above each of the divider/shelves 135 in the primary blank 101.

Accordingly, the face of the front panel 110 (which will become the interior face of the panel 110) is affixed in the adhesive locations 170 to the bottom face of the auxiliary panel 102. Subsequently, the back panel 120 is folded towards the side panel 105 and over the auxiliary blank 102. Then, the adhesive panel 190 (which holds some mechanism for affixing and includes a plurality of adhesive locations 170) is affixed to the far edge of back panel 120. Additionally, a plurality of the minor panels 145 are affixed to one another and the minor panels 145 and major panels 150 interact and cooperate to form the bottom panel 130 of the container 100 in a knockdown configuration.

Accordingly, the preassembly or knockdown of the container 100 is thus formed in a rectangular configuration.

FIGS. 5-8 illustrate various stages of the final assembly of the container 100 and are provided to further explain the utility of the illustrated embodiments. As will become clear from the operations performed in FIGS. 5-8, the illustrated embodiment provides materials for and a method for manufacturing containers for shipping and/or display and resulting such containers that have improved utility by enabling increased ease and speed of final assembly of containers as well as associated reliability and reproducibility because of the ease of assembly.

Figure 5:
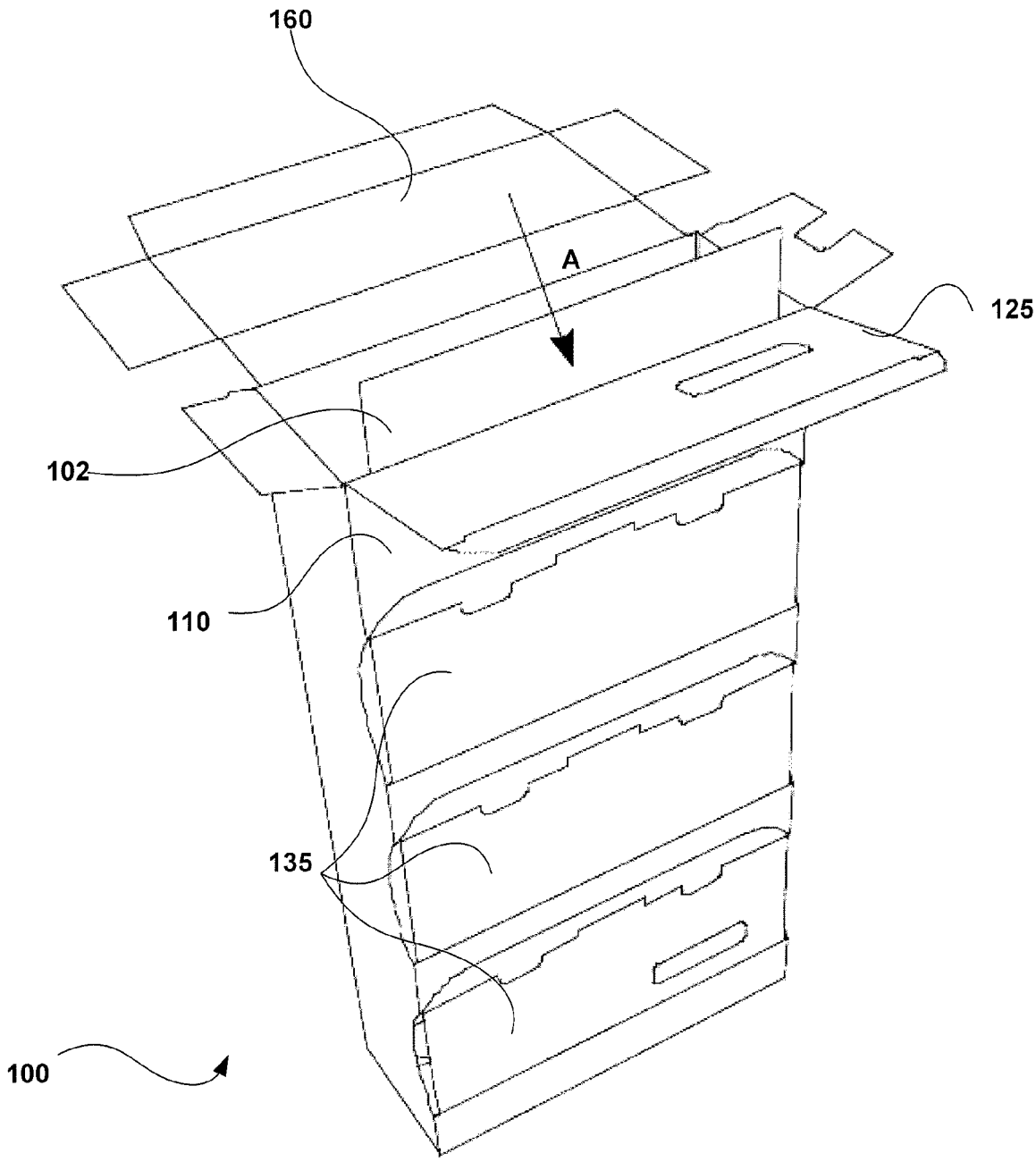
FIG. 5 illustrates a side perspective of the pre-assembly manufactured from the blanks illustrated in FIG. 4 at a first stage of final assembly.

As illustrated FIG. 5, the preassembly resulting from the above-described operations can be set into an upright position by performing conventional operations to fully assemble the bottom panel 130 (illustrated in FIGS. 1-2). As a result of such operations, the container 100 is provided with an open top and uninstalled dividers/shelves 135. As shown in FIG. 5, when in this upright position, the auxiliary blank 102 is affixed to the interior side of the front panel 110 at the adhesive locations 170 (shown in FIG. 4). Accordingly, the top edge of the blank 102 is positioned higher than the top edge of the front panel 110.

As part of a first stage of final assembly, an assembler (e.g., retail personnel) pushes the top edge of the blank 102 downward in a direction A. As a result, of that pressure, a top edge of the dividers/shelves 135 is separated from the front panel 110.

Figure 6:
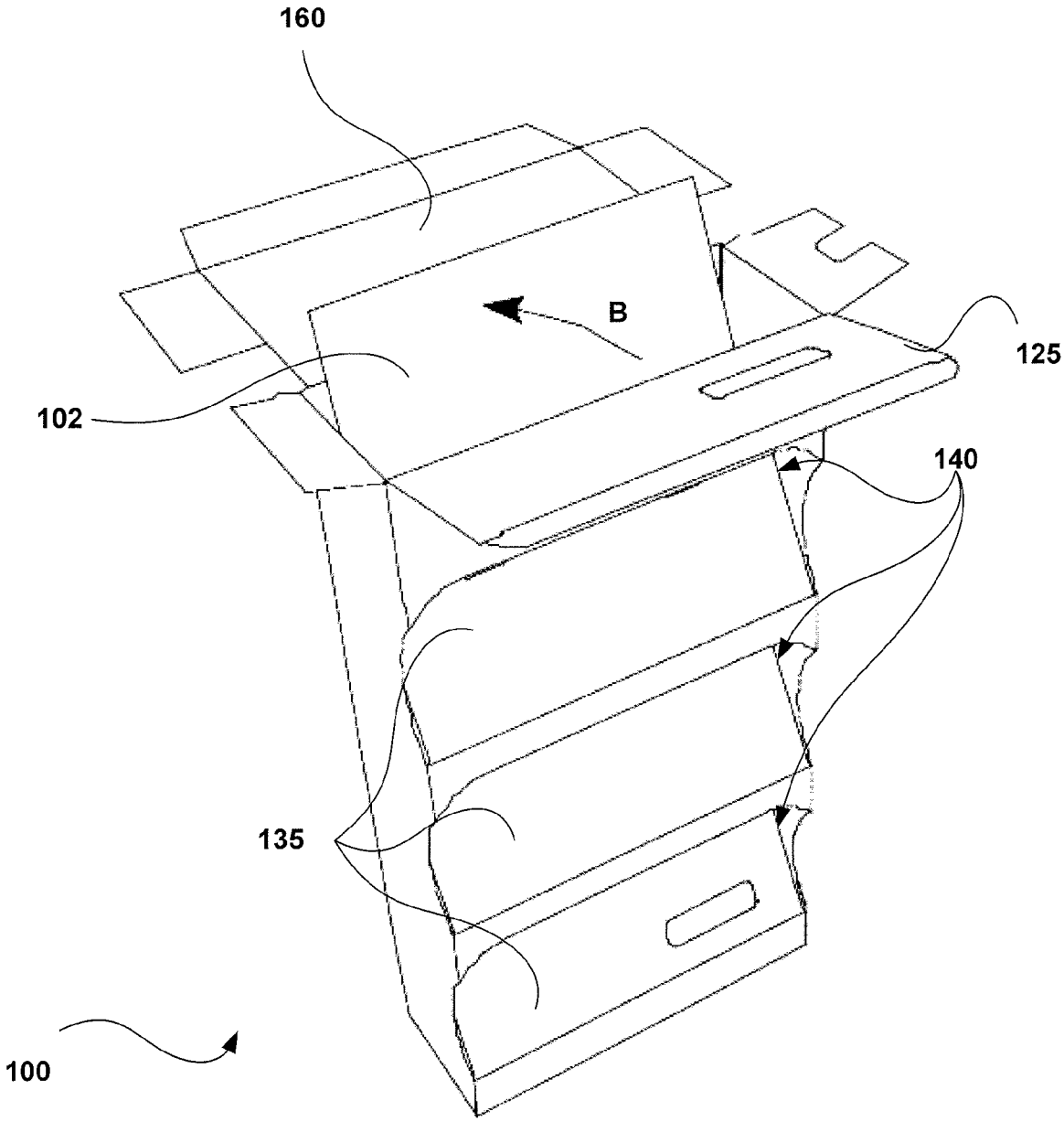
FIG. 6 illustrates a side perspective of the pre-assembly manufactured from the blanks illustrated in FIG. 4 at a second stage of final assembly.

As a result, the container 100 is configured as illustrated in FIG. 6. Accordingly, in a second stage of final assembly, the assembler pushes the blank 102 in a direction B, towards the back panel 120 of the container 100. As a result, the dividers/shelves 135 are pulled towards the back panel 120 as well because the interior side of the front panel 110 that comprise the dividers/shelves 135 are affixed to the auxiliary blank 102 at the adhesive locations 170 illustrated in FIG. 4.

The assembler pushes the auxiliary blank 102 in the direction B until the back face of the auxiliary blank 102 is in contact with the interior face of the back panel 120. At that point, the divider/shelf lock slots 155 located in the back panel 120 line up with the divider/shelf lock slots 165 provided in the blank 102. Additionally, the tabs 175 provided as part of the dividers/shelves 135 are positioned in close proximity to the co-located slots 155, 165.

Figure 7:
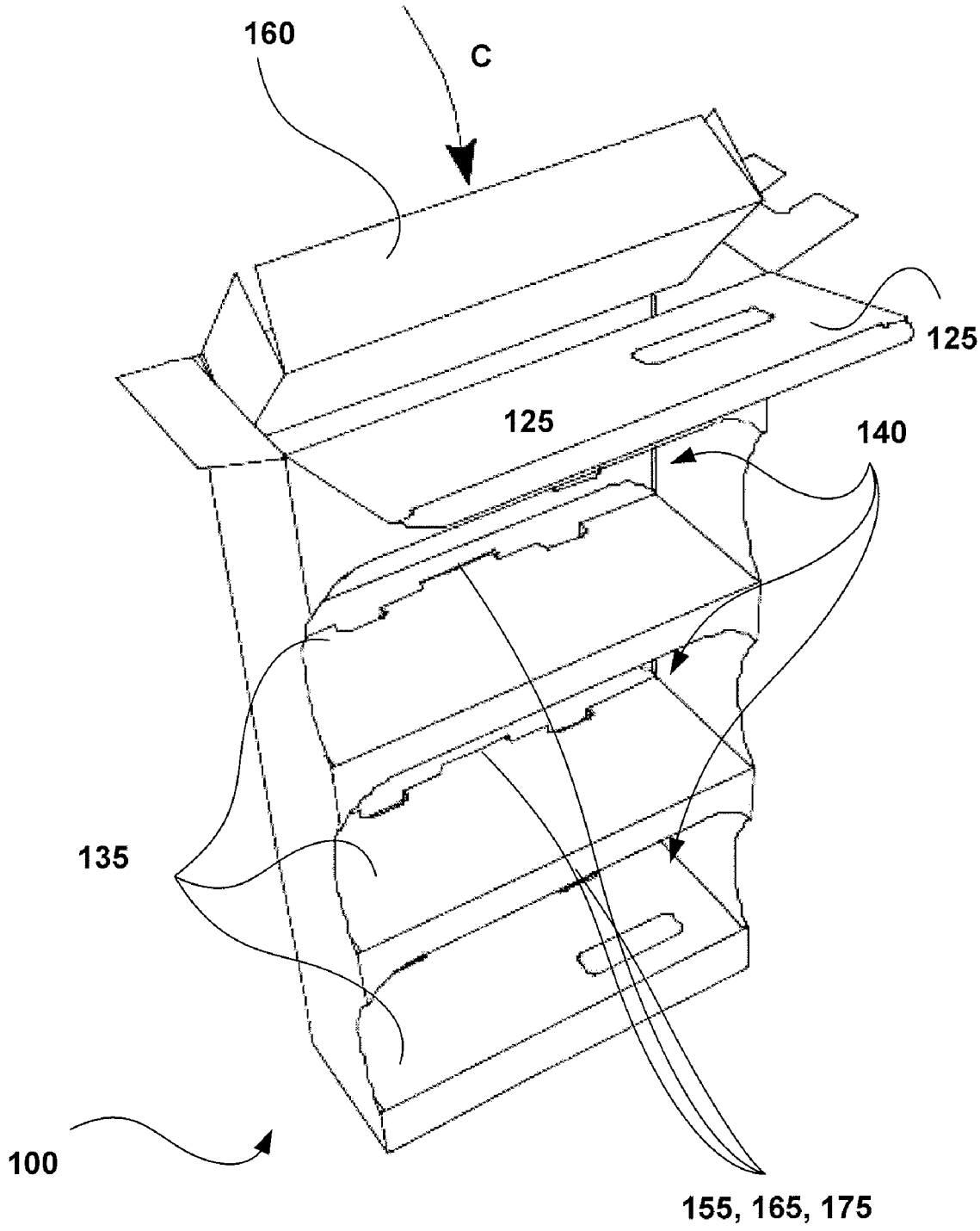
FIG. 7 illustrates a side perspective of the pre-assembly manufactured from the blanks illustrated in FIG. 4 at a third stage of final assembly.

Accordingly, as illustrated in FIG. 7, the assembler simply applies downward pressure to each of the tabs 175 to lock each of the dividers/shelves 135 into their respective lock slots 165 (or lock slot pairs 155, 165 if the length of the tabs so enables) to provide cells 140.

Additionally, if the container 100 includes a head space filler panel 160 (which is entirely optional), the assembler folds the panels and inserts the head space filler panels 160 into the interior of the container 100 in the direction C.

Subsequently, as illustrated in FIG. 8, the top panel 125 may be folded over in direction D and an included tab may be inserted into the interior of the container 100 to affix the top panel 125 to the back panel 120. As an additional operation, if the container includes perforations or cut-outs for publication apertures 195 (for holding publications, or other associated printed material relating to the product to be displayed or stored in the container 100), the perforations may be used to remove the material and open the publication apertures for use with the display. However, it should be understood that the publication apertures 195 are not central to the inventive concept and may be omitted.

Although FIGS. 1-8 illustrate one example of a container that may be manufactured in accordance with illustrated embodiments, various different types of blanks and preassemblies may be used to produce various different types of containers. Thus, although one or more of the side panels may be configured in a rectangular shape, various other shapes are also suitable. Further, although illustrated in FIGS. 1-8, a primary blank 101 used to construct a container need not include a head space filler as provided by head space filler panels 160. Accordingly, the head space filler panels 160 may be omitted.

Figure 9:
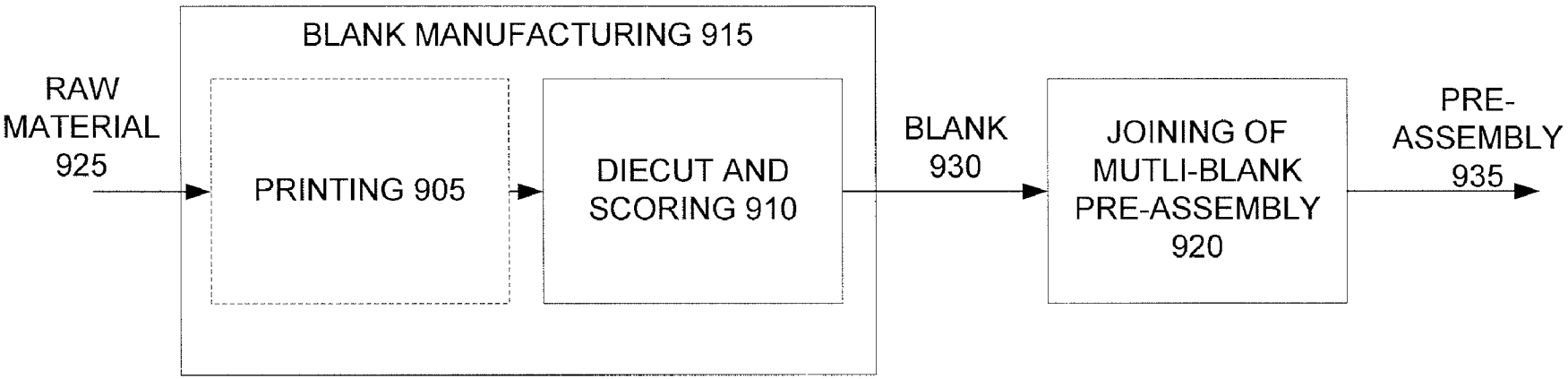
FIG. 9 illustrates a functional block diagram used to describe the manufacturing method of containers in accordance with an illustrated embodiment.

FIG. 9 illustrates a functional block diagram showing the operation of various method functions performed in accordance with a method of producing preassemblies in conjunction with illustrated embodiments. As alluded to in the background section, and as conventionally known, the manner of manufacturing containers such as the example illustrated in FIGS. 1-8 may be conveniently described in two phases: pre-assembly and final assembly/use.

Preassembly is normally performed at a container manufacturing facility to produce a preassembly which may also be thought of and referred to as a knockdown of the container. These preassemblies may be shipped to a customer location such as a product manufacturing facility or retail environment or third party fulfilment contract packaging facility. At that destination, the container customer may perform final assembly/use of the containers by, for example, folding and assembling various panels of the container to provide a container that is configured to hold manufacture product, e.g., for shipping and/or display (e.g., as illustrated in FIGS. 5-8).

In such operations, the manufacturing of the container preassemblies may be performed by the customer of the preassemblies and/or as part of manufacture of the preassemblies as illustrated in FIG. 9.

FIG. 9 illustrates various functional operations performed as part of the manufacture of a preassembly by, for example, a display, shipping or display ready packaging manufacturer. The operations may begin, for example, with printing 905 of container material prior to the container material being die cut and/or scored 905 as part of an overall blank manufacturing operation 915. The manufactured blanks 930 may or may not be printed on one or both sides of the blanks 930 depending on customer requirements. Accordingly, the printing operation 905 may be omitted.

Subsequent to blank manufacturing 915, the manufactured blanks may be affixed to one another as part of the joining of multi-blank pre-assembly operations 920. The operations performed at 920 may be performed in various suitable manners including by hand or using various commercially available machines (for example, those produced by Bahmueller Technologies, Inc. of Charlotte, N.C., USA or Bobst Group North America of Roseland, N.J., USA). Thus, the operations performed at 920 may produce preassemblies for containers such as that illustrated in FIG. 1.

Therefore, it should be appreciated that one or more of the operations performed to produce blanks, preassemblies, knockdowns and containers may be performed in whole or in part by machines and or human personnel. Moreover, human personnel may utilize one or more different types of machines and/or tools to perform assembly operations performed either to manufacture preassemblies or finally assembled containers.

Thus, at the beginning of such operations, raw material 925 is used to produce blanks 930. Such raw materials 925 may include but are not limited to various grades, types, configurations and combinations of corrugated fiberboard and/or solid paperboard, liner board, board of various fluting types and combinations as well as various types of sealants, non-organic materials and inks and dies of various suitable types.

It should be understood that implementation of the method and system of the present invention involves performing or completing certain selected tasks or steps manually, automatically, or a combination thereof.

While this invention has been described in conjunction with the specific embodiments outlined above, it is evident that many alternatives, modifications and variations will be apparent to those skilled in the art. Accordingly, the various embodiments of the invention, as set forth above, are intended to be illustrative, not limiting. Various changes may be made without departing from the spirit and scope of the invention.

For example, various illustrated features of the preassembly and resulting containers may be omitted. For example, the headspace filler 160, powerwing apertures 180, 185 and publication apertures 195 may be omitted. Additionally, it should be understood that various types of containers and container components may be manufactured in the manner described. For example, although bottom panel 130 is for an autolock bottom type container, various other types of bottoms may be incorporated. As a result, the configurations and components of the primary and auxiliary blanks are merely illustrative and not limiting.

Further, as mentioned briefly, containers may be manufactured that stand on one of the side panels 105, 115 or the back panel 120. As a result, a container may be utilized as a set of storage bins or as a nested, compartmentalized storage container rather than as a display shelf.

Furthermore, it should be understood that invention embodiments are capable of variations practiced or carried out in various ways. Therefore, it should be appreciated that, in accordance with at least one embodiment of the invention, any and all of the walls may be constructed of corrugated cardboard. However, it should be understood that the walls, panels, any tabs on various panels, etc., may be constructed of various industry recognized appropriate materials that meet various transporting and/or display criteria. As a result, it should be understood that containers manufactured in accordance with at least one embodiment of the invention may also be considered "cartons," which may be considered packaging or display containers, commonly made from cardstock or cardboard. Further, it should be understood that cartons come in many different varieties but most cartons can be folded and assembled from a flat form, known as a carton blank. Thus, it should be understood that the pattern for any blank, preassembly or container may be different than those described herein.

Alternatively, or more specifically, the packaging and/or display containers may be made using corrugated board, e.g., material made by a corrugator (a machine that produces corrugated board by attaching fluting to liners) which is a structured board formed by gluing one or more arched layers of corrugated medium to one or more flat-facing linerboards.

Additionally, it should be appreciated that material used in accordance with at least one embodiment of the invention may be laminated to provide barrier properties. Further, other barrier materials may be used including Ultra Violet (UV), moisture and gas barriers. Additionally, though not discussed in detail herein, it should be understood that any adhesive used to provide a bond between materials used in containers provided in accordance with the invention may include any substance that helps bond two materials together, examples including but not limited to glue and paste.

Further, it should be appreciated that the material used to form the primary blank 101 may be different, stronger, or weaker than the blank used to form the auxiliary blank 102. Thus, for example, use of an auxiliary blank 102 that is of a heavier, more durable or stronger material than the material used for primary blank 101, may provide the increased ease of final assembly as well as increased durability or strength to the resulting container 100 while reducing the amount of material in the container (something of interest for environmental and cost issues).

It should also be appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

Additionally, it should be understood that the functionality described in connection with various described components of various invention embodiments may be combined or separated from one another in such a way that the architecture of the invention is somewhat different than what is expressly disclosed herein. Moreover, it should be understood that, unless otherwise specified, there is no essential requirement that methodology operations be performed in the illustrated order; therefore, one of ordinary skill in the art would recognize that some operations may be performed in one or more alternative order and/or simultaneously.

As a result, it will be apparent for those skilled in the art that the illustrative embodiments described are only examples and that various modifications can be made within the scope of the invention as defined in the appended claims.

The invention claimed is:

1. A method of manufacturing a container, the method comprising:

cutting a primary blank including a plurality of panels including a first panel and a second panel, wherein the first panel includes a plurality of divider sections each including a first portion and a second portion separated by a perforation, the first portion including a plurality of divider tabs and the second portion including a section configured to carry adhesive, and wherein the second panel is configured to oppose the first panel during assembly and includes a corresponding first plurality of divider lock slots;

cutting an auxiliary blank including a second plurality of divider lock slots; and affixing the primary blank to the auxiliary blank using adhesive applied to the second portion section of each of the plurality of divider sections, such that, as the container is assembled, pressure on the auxiliary blank separates the first portion of each of the plurality of divider sections from the second portion and carries each of the plurality of divider tabs to engage with corresponding lock slots of the first and second divider lock slots so as to lock the plurality of dividers sections in place orthogonal to the first and second panels.

2. The method of claim 1, wherein the container is a display.

3. The method of claim 1, wherein the plurality of panels includes a front panel, back panel and two side panels.

4. The method of claim 3, wherein the plurality of panels includes a top panel and at least one bottom panel.

5. The method of claim 1, wherein the first panel is a front panel of the container following assembly.

6. The method of claim 5, wherein the second panel is a back panel of the container following assembly.

7. The method of claim 1, wherein a top panel included in the plurality of panels includes at least one perforated section removable to provide an opening for holding printed material.

8. The method of claim 1, wherein a back panel included in the plurality of panels includes a t-lock aperture.

9. The method of claim 1, wherein a back panel included in the plurality of panels includes at least one powerwing clip slot.

10. A container preassembly comprising:

a primary blank including a plurality of panels including a first panel and a second panel, wherein the first panel includes a plurality of divider sections each including a first portion and a second portion separated by a perforation, the first portion including a plurality of divider tabs and the second portion including a section configured to carry adhesive, and wherein the second panel is configured to oppose the first panel during assembly and includes a corresponding first plurality of divider lock slots; and an auxiliary blank including a second plurality of divider lock slots;

wherein the primary blank is affixed to the auxiliary blank using adhesive applied to the second portion section of each of the plurality of divider sections, such that, as the container is fully assembled, pressure on the auxiliary blank separates the first portion of each of the plurality of divider sections from the second portion and carries each of the plurality of divider tabs to engage with corresponding lock slots of the first and second divider lock slots so as to lock the plurality of dividers sections in place orthogonal to the first and second panels.

11. The preassembly of claim 10, wherein the container is a display.

12. The preassembly of claim 10, wherein the plurality of panels includes a front panel, back panel and two side panels.

13. The preassembly of claim 10, wherein the plurality of panels includes a top panel and at least one bottom panel.

14. The preassembly of claim 10, wherein the first panel is a front panel of the container following assembly.

15. The preassembly claim 14, wherein the second panel is a back panel of the container following assembly.

16. The preassembly of claim 10, wherein a top panel included in the plurality of panels includes at least one perforated section removable to provide an opening for holding printed material.

17. The preassembly of claim 10, wherein a back panel included in the plurality of panels includes a t-lock aperture.

18. The preassembly of claim 10, wherein a back panel included in the plurality of panels includes at least one powerwing clip slot.

19. A plurality of blanks for a container preassembly, the plurality of blanks comprising:

a primary blank including a plurality of panels including a first panel and a second panel, wherein the first panel includes a plurality of divider sections each including a first portion and a second portion separated by a perforation, the first portion including a plurality of divider tabs and the second portion including a section configured to carry adhesive, and wherein the second panel is configured to oppose the first panel during assembly and includes a corresponding first plurality of divider lock slots; and an auxiliary blank including a second plurality of divider lock slots;

wherein the auxiliary blank is configured to mate with and be affixed to the primary blank using adhesive applied to the second portion section of each of the plurality of divider sections, such that, when the primary and auxiliary blanks are affixed to one another to provide a preassembly and the preassembly is fully assembled, pressure on the auxiliary blank separates the first portion of each of the plurality of divider sections from the second portion and carries each of the plurality of divider tabs to engage with corresponding lock slots of the first and second divider lock slots so as to lock the plurality of dividers sections in place orthogonal to the first and second panels.

20. The plurality of blanks of claim 19, wherein the container is a display.

21. The plurality of blanks of claim 19, wherein the plurality of panels includes a front panel, back panel and two side panels.

22. The plurality of blanks of claim 21, wherein the plurality of panels includes a top panel and at least one bottom panel.

23. The plurality of blanks of claim 19, wherein the first panel is a front panel of the container following assembly.

24. The plurality of blanks of claim 23, wherein the second panel is a back panel of the container following assembly.

25. The plurality of blanks of claim 19, wherein a top panel included in the plurality of panels includes at least one perforated section removable to provide an opening for holding printed material.

26. The plurality of blanks of claim 19, wherein a back panel included in the plurality of panels includes a t-lock aperture.

27. The plurality of blanks of claim 19, wherein a back panel included in the plurality of panels includes at least one powerwing clip slot.

* * * * *